US010995548B2

(12) United States Patent
Cornthwaite

(10) Patent No.: US 10,995,548 B2
(45) Date of Patent: May 4, 2021

(54) FOLDABLE STEP

(71) Applicant: TNICO Technology Division Ltd., Leduc (CA)

(72) Inventor: Don Cornthwaite, Red Deer (CA)

(73) Assignee: TNICO Technology Division Ltd., Leduc (CA)

( * ) Notice: Subject to any disclaimer, the term of this patent is extended or adjusted under 35 U.S.C. 154(b) by 255 days.

(21) Appl. No.: 16/287,382

(22) Filed: Feb. 27, 2019

(65) Prior Publication Data

US 2019/0195015 A1 Jun. 27, 2019

Related U.S. Application Data

(63) Continuation-in-part of application No. 15/780,440, filed as application No. PCT/CA2016/051443 on Dec. 8, 2016, now Pat. No. 10,253,565.

(60) Provisional application No. 62/264,999, filed on Dec. 9, 2015.

(51) Int. Cl.

| | |
|---|---|
| ***E06C 1/16*** | (2006.01) |
| ***E06C 1/34*** | (2006.01) |
| ***A47B 77/10*** | (2006.01) |
| ***E06C 1/393*** | (2006.01) |
| ***A47B 97/00*** | (2006.01) |
| ***E06C 1/00*** | (2006.01) |

(52) U.S. Cl.

CPC ..... *E06C 1/34* (2013.01); *A47B 77/10* (2013.01); *A47B 97/00* (2013.01); *E06C 1/005* (2013.01); *E06C 1/16* (2013.01); *E06C 1/393* (2013.01); *A47B 2220/05* (2013.01)

(58) Field of Classification Search

CPC ... E06C 1/16; E06C 1/393; E06C 1/35; E06C 1/005; A47B 2220/05; A47B 77/10; A47B 97/00

See application file for complete search history.

(56) References Cited

U.S. PATENT DOCUMENTS

| | | | | |
|---|---|---|---|---|
| 1,427,588 A * | 8/1922 | Greenison | ..... | E06C 7/16 182/21 |
| 2,743,861 A | 5/1956 | Mattis et al. | | |
| 3,030,166 A | 4/1962 | Richards et al. | | |
| 5,131,492 A | 7/1992 | Caminiti et al. | | |

(Continued)

FOREIGN PATENT DOCUMENTS

| | | | | |
|---|---|---|---|---|
| DE | 3327025 A1 * | 2/1985 | ..... | E06C 1/393 |
| DE | 3700855 A1 * | 7/1988 | ..... | E06C 1/393 |

(Continued)

*Primary Examiner* — Alvin C Chin-Shue
(74) *Attorney, Agent, or Firm* — McMillan LLP

(57) ABSTRACT

The present invention relates to at least a foldable step. The step features an upper and a lower step supported by a structure including a right side each having a vertical support member, an angled support member, and upper and lower step support members. A horizontal front support member provides support for the lower step. Left and right diagonal support members are slidably coupled to the upper step support members. A rear horizontal support member and optional diagonal members provide additional support to the upper step. The step is foldable into a folded position, by folding both the upper and lower steps upwardly. The step has a minimal profile in the folded position.

15 Claims, 9 Drawing Sheets

(56) References Cited

U.S. PATENT DOCUMENTS

| | | | | |
|---|---|---|---|---|
| 6,039,149 | A * | 3/2000 | Bedja | B62B 1/12 182/165 |
| 6,427,804 | B1 * | 8/2002 | Lazarus | A47C 7/008 182/153 |
| 2002/0096918 | A1 * | 7/2002 | Russomanno | E06C 1/005 297/217.1 |
| 2015/0001005 | A1 | 1/2015 | Goodson | |

FOREIGN PATENT DOCUMENTS

| | | | | |
|---|---|---|---|---|
| DE | 9406106 | U1 * | 5/1995 | E06C 1/393 |
| FR | 1265972 | A * | 7/1961 | E06C 1/393 |
| FR | 2341286 | A1 * | 9/1977 | E06C 1/005 |

* cited by examiner

FOLDABLE STEP

CROSS REFERENCES

This application claims is a continuation-in-part of U.S. patent application Ser. No. 15/780,440 which is national stage entry of international application PCT/CA2016/051443 which claims priority from U.S. provisional patent application No. 62/264,999, and the contents of all of those applications are herein incorporated by reference in their entirety.

FIELD OF THE INVENTION

The present invention relates generally to a foldable step. More particularly, the present invention relates to at least a foldable step mounted within a cabinet or cupboard of varying heights and having a minimal folded profile.

BACKGROUND OF THE INVENTION

U.S. Patent Publication No. 2015/0001005 to Goodson discloses a folding step stool that is mounted and stored within a cabinet. When not in use, the entirety of the folding step stool may be disposed within an interior of the cabinet to permit closure of the cabinet door. When required, the cabinet door may be opened and the step stool may be deployed to provide one or more steps for use in accessing a counter or sink above the cabinet. If the cabinet is a non-standard height, Goodson requires the use of adjustable feet having a threaded screw on the lower end of each leg.

U.S. Pat. No. 5,697,470 to Carle describes a ladder assembly which can be slidably withdrawn from and deployed out of the integral housing, remaining slidably joined to said housing while said housing is fastened to an independent support structure, pivoted upon the integral hinge and axle pivot mechanisms, have the ladder legs contact the floor in an angular relationship, and provide at least one rigid and sturdy step or rung horizontally spanning the distance between said ladder legs a desired distance from the floor and essentially parallel thereto upon which a user can place one or both feet, stand, and thereby conveniently reach places or objects located above an elevation that could be reached while standing on the floor.

U.S. Pat. No. 5,131,492 to Caminiti teaches a collapsible folding step stool, which is mountable to a cabinet door. The step stool has a bracket mountable to the cabinet door; a platform movable between a lowered, generally horizontal, operative position and a raised, generally vertical, inoperative position; a plurality of parallel arms attached at their first ends to the platform and pivotally coupled at their second ends to the bracket; and a plurality of parallel support legs movable between a generally vertical operative position perpendicular to the platform and a generally vertical inoperative position parallel with the platform and the bracket. The support legs have upper ends pivotally coupled to the platform and lower ends which, when the platform is in the operative position, are adapted to rest on the floor with the lower ends of the legs at a lower elevation than the bottom of the bracket. U.S. Pat. No. 3,136,386 to Horvath et al. describes a foldaway step mounted inside the door of a kitchen cabinet and arranged to be folded away flat against the inside of the door when not in use. The step is arranged to slide up and down on a plate attached to the inside of a cabinet door so that when moved upward it can be folded flat and locked in position inside the door and when moved downward and unfolded it comes into engagement with the floor below the door in whatever position to which the door has been opened and provides a solid step which does not provide any strain on the door itself when used as a step.

U.S. Pat. No. 3,030,166 to Richards et al. discloses a cabinet and stepladder, which does not utilize the cabinet storage space when in the folded position. The stepladder has lower and upper steps pivotally moved on rods so that their adjacent edge portions move into interfitting engagement along a joint. The legs are pivotally connected to opposite sides of the steps adjacent the forward edges of the steps by pivot rods, which are positioned within grooves in the forward edges of the steps. The rods are secured to the legs as to permit pivotal movement of the legs.

In the previously described foldable steps, they must be precisely installed or require adjustment of leg lengths after installation. Moreover, they do not automatically position themselves to have legs in full contact with the floor while maintaining horizontal steps. It is an object of this invention to at least provide a novel foldable step capable of automatically adjusting its height to different cabinet heights without requiring adjustment. The cupboard door does not provide any structural support to the foldable step. It only houses and stores the step hidden when not in use.

SUMMARY OF THE INVENTION

According to one aspect of the invention, there is at least provided a foldable step for installing within a cupboard comprising: an upper cross member and a lower cross member coupled in a horizontal orientation to the cupboard. A right side and a left side each comprise: a cupboard support member aligned vertically with the cupboard and coupled to the upper and lower cross members; at least two offset members pivotally coupled at one end to the cupboard support member; the offset members pivotally coupled at the other end to a vertical support member; an upper step support member pivotally coupled at one end to the top of the vertical support member; a lower step support member, being longer than the upper step support member, pivotally coupled near a midway along the vertical support member; an inter-step support member pivotally coupled at one end to the end of the upper step support and pivotally coupled at the other end to a point along the length of the lower step support member; an angled support member pivotally coupled at one end to the end of the upper step support and slidably coupled along the angled support member to the lower step support member between the point along the length of the lower step support and the end of the lower step support; an upper step coupled between the upper step support members of the right and left sides; and a lower step coupled between the lower step support members of the right and left sides. An upper offset member and a lower offset member may be selected from the at least two offset members where the lower offset member comprises a notch in the lower offset member that generally aligns with one of the joints between the other support members. The vertical support member may also comprise one or more notches that align with the joints of the other support members. The upper cross member and lower cross member may be coupled to the cupboard door by way of one or more brackets.

According to another aspect of the invention, there is at least provided a method of folding and unfolding a foldable step by rotating and sliding the joints according to the structure described herein.

According to another aspect of the invention, there is at least provided a foldable step for installing within a cupboard. The foldable step comprises a right side and a left side, an upper step supported by the upper step support members of the right and left sides, a lower step supported by the lower step support members of the right and left sides; and a front horizontal support member extending between the angled support members of the right and left sides, and positioned for supporting the lower step when the foldable step is in an in-use position.

The right side and left side each comprises: a vertical support member, an upper step support member, a diagonal support member and an angled support member. The vertical support member has a top end and a floor end. The upper step support member has: a first end pivotally coupled to the top end of the vertical support member, a second end, and a longitudinal slot extending between the second end thereof and an intermediate point along the upper step support member. The an inner and an outer lower step support members, are each longer than the upper step support member, have a first end pivotally coupled to the vertical support member between the top end and the floor end, and have a second end. A longitudinal slot is formed in the outer lower step support member between the second end thereof and a point intermediate the first end thereof and second end thereof. The diagonal support member: is pivotally coupled at a first end to the vertical support member between the upper step support member and the outer lower step support member, and is slidably coupled at a second end thereof to the longitudinal slot formed in the upper step support member. The angled support member: has a top end pivotally coupled to the second end of the upper step support member and a floor end, and is slidably coupled at an intermediate point thereof to the longitudinal slot of the outer lower step support member.

The upper step is supported by the upper step support members of the right and left sides. The lower step is supported by the lower step support members of the right and left sides.

The front horizontal support member extending between the angled support members of the right and left sides, and positioned for supporting the lower step when the foldable step is in an in-use position.

In one embodiment, the foldable step further comprises a coupling assembly for coupling the foldable step to the cupboard.

In one embodiment, the foldable step comprises a rear horizontal support member extending between the right and left vertical support members, and positioned for further supporting the upper step when the foldable step is in the in-use position.

In one embodiment, the foldable step further comprises a right and a left rear diagonal support members connecting the rear horizontal support member to the vertical support members of the right and left sides, respectively, for providing additional lateral resistance and stability.

BRIEF DESCRIPTION OF THE DRAWINGS

An embodiment will now be described, by way of example only, with reference to the attached Figures, wherein.

DETAILED DESCRIPTION OF THE EMBODIMENT

While the Background of Invention described above has identified particular problems known in the prior art, the present invention provides at least, in part, a new and useful application for an improved hidden foldable step.

Figure 1:
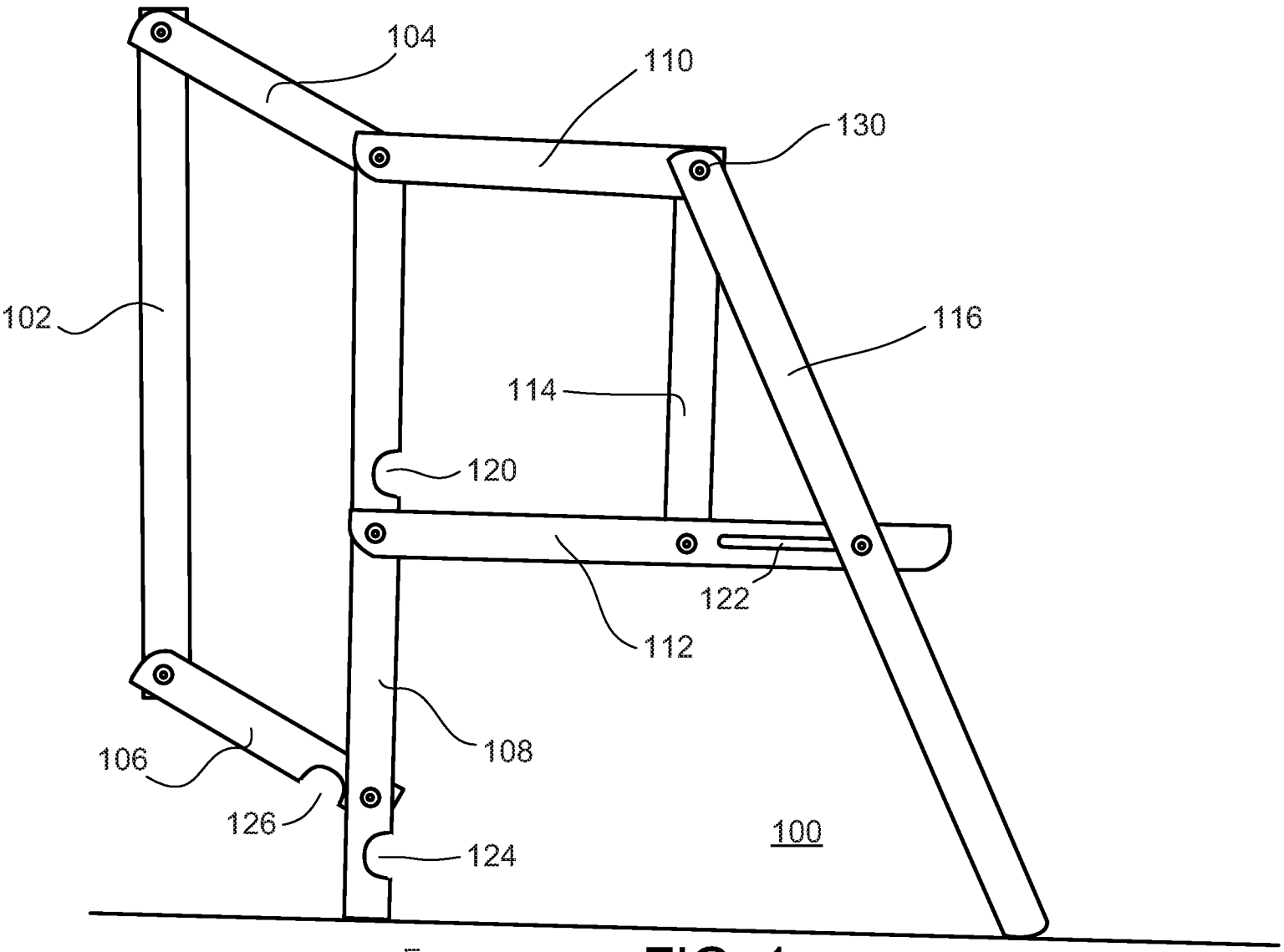
FIG. 1 shows a side view of a foldable step in an in-use configuration, in accordance with an embodiment of the present invention.
Figure 3:
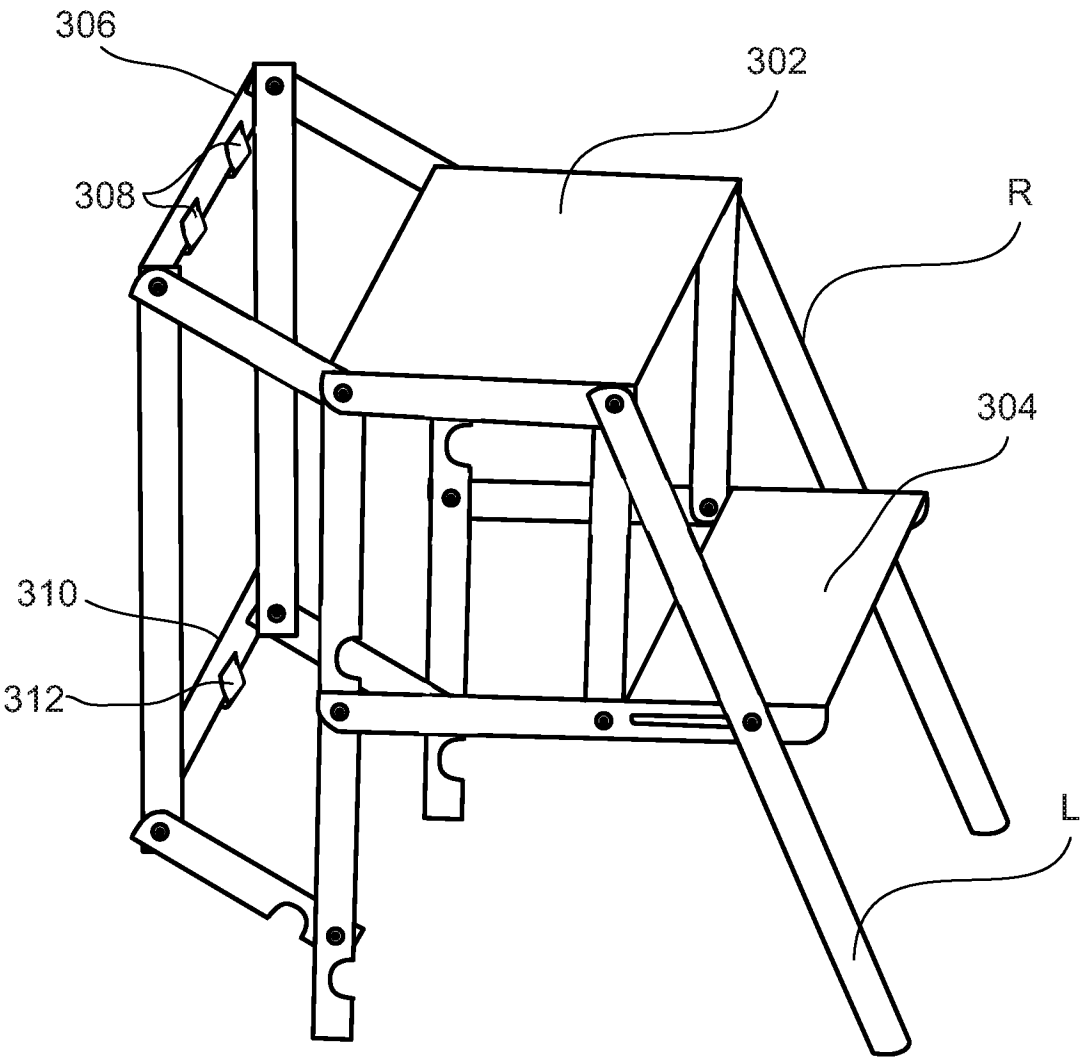
FIG. 3 shows a perspective view of the foldable step of FIG. 1 in an in-use configuration.
Figure 4:
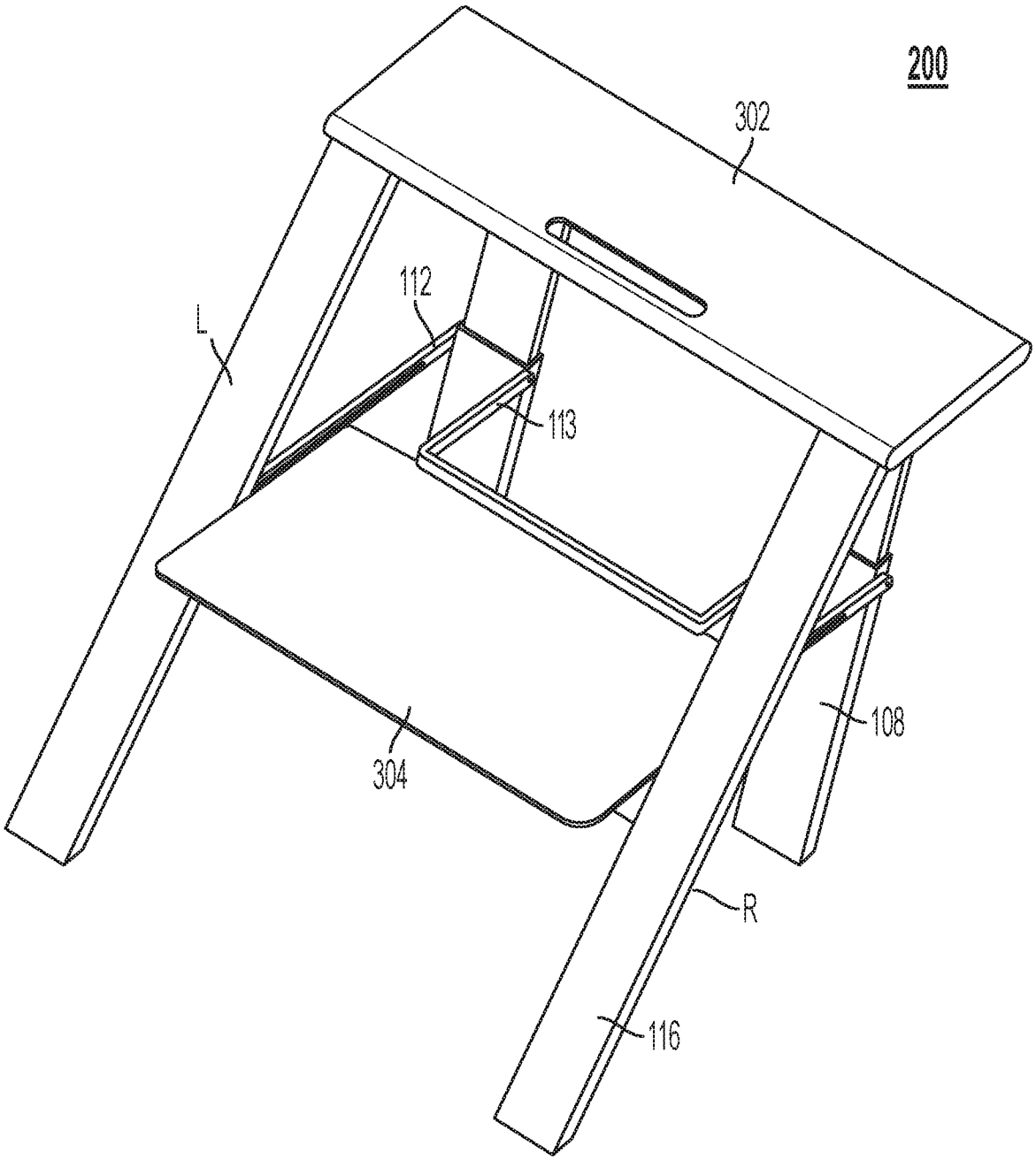
FIG. 4 shows a top perspective view of a foldable step in an in-use configuration, in accordance with another embodiment of the present invention.
Figure 5:
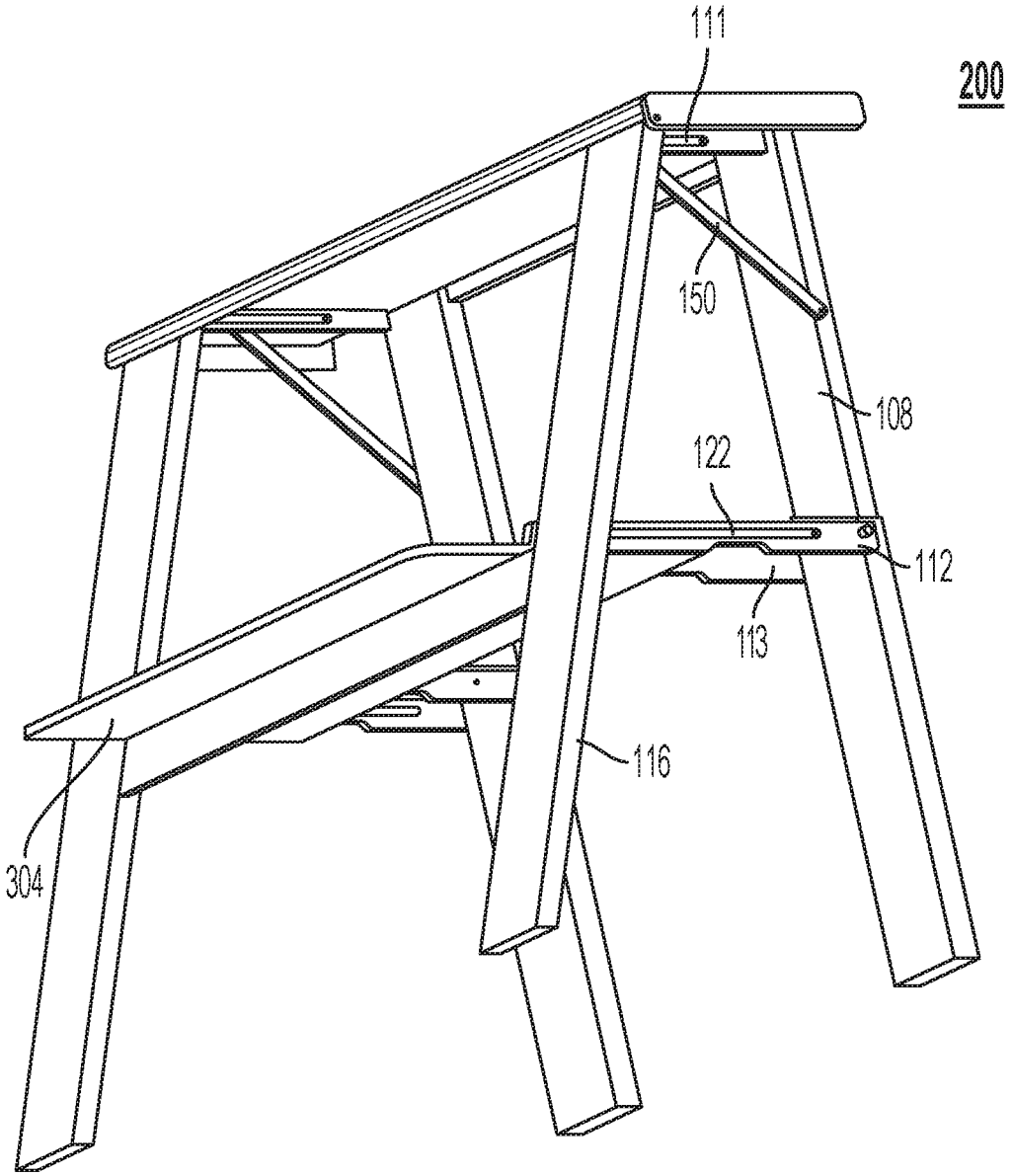
FIG. 5 shows a top perspective view of the foldable step of FIG. 4 in an in-use configuration.
Figure 6:
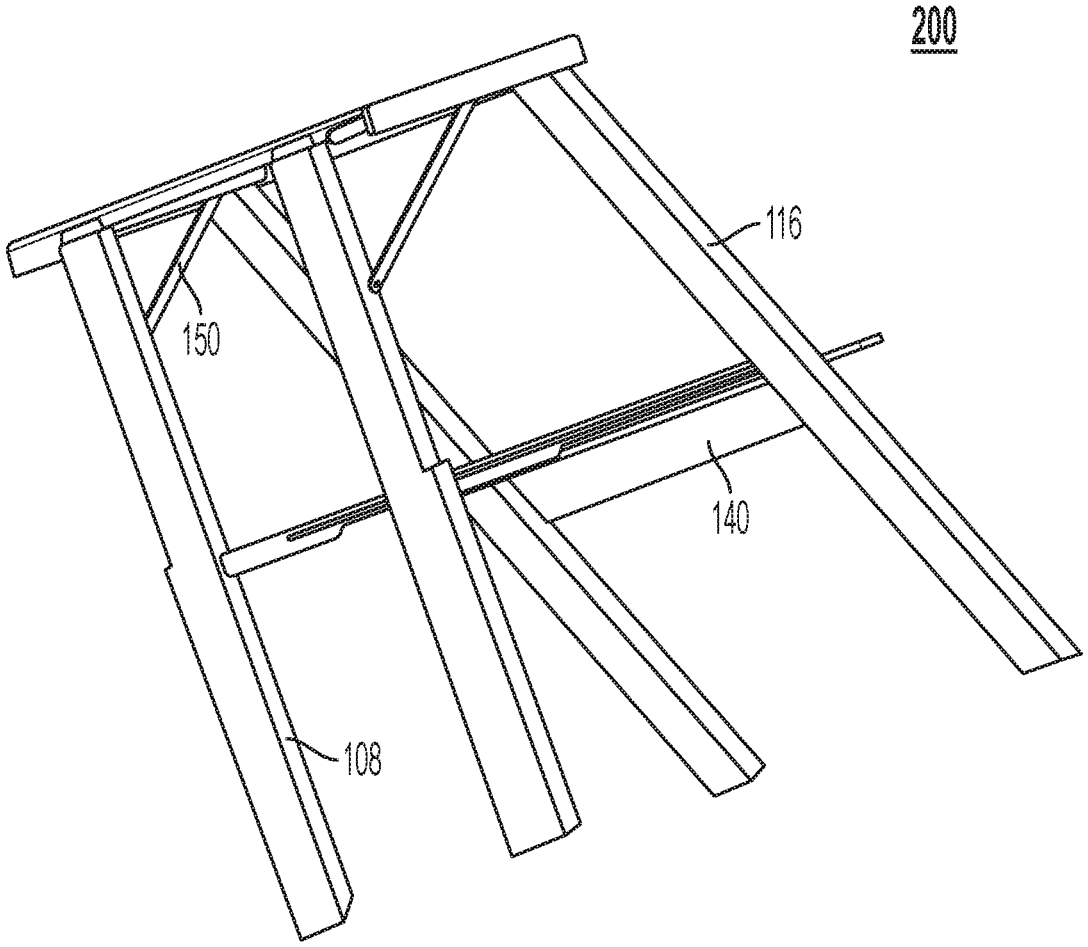
FIG. 6 shows a rear perspective view of the foldable step of FIG. 4 in an in-use configuration.
Figure 7:
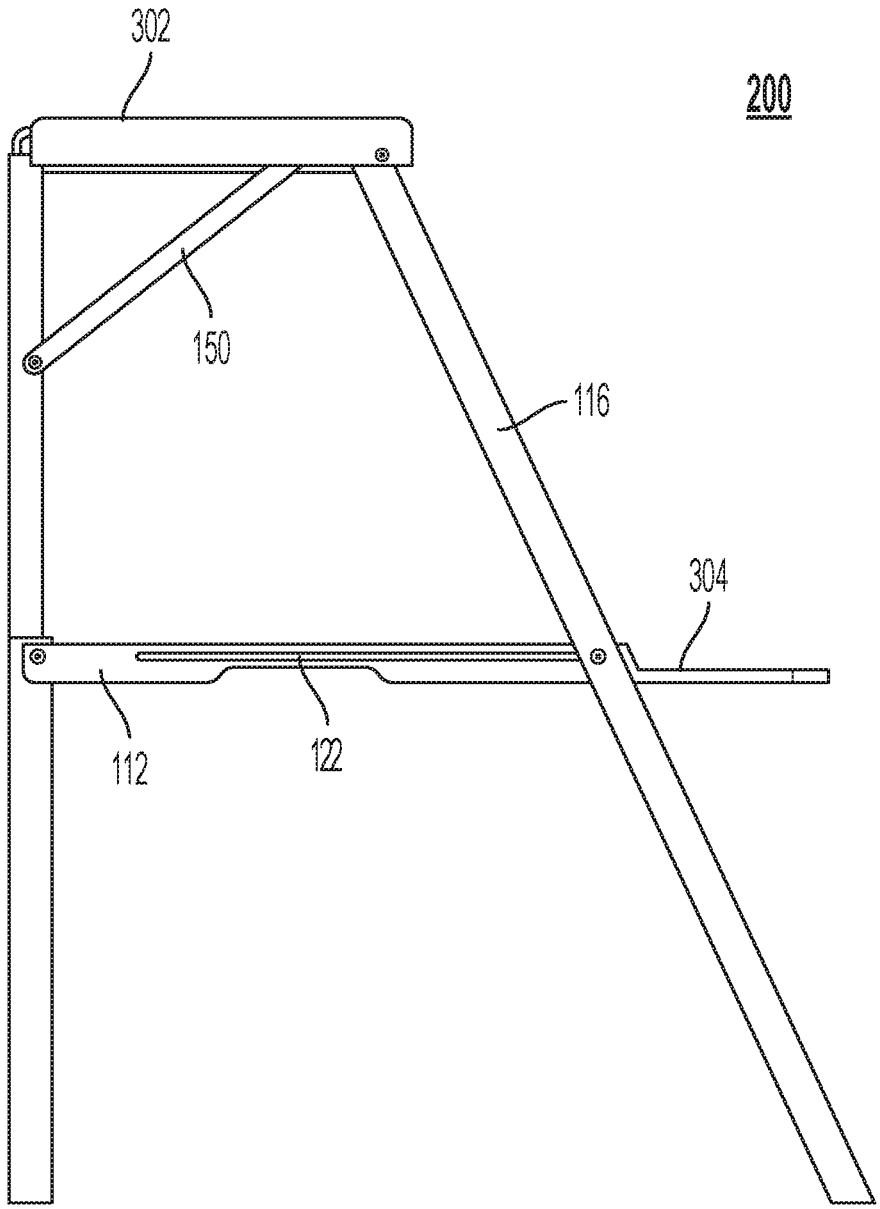
FIG. 7 shows a side view of the foldable step of FIG. 4 in an in-use configuration.

FIGS. 1 and 3 show a foldable step 100 in an in-use configuration. The foldable step 100 is generally formed using a plurality of structural supports (102, 104, 106, 108, 110, 112, 114, 116) pivotally or rotatably coupled to one another using a plurality of pins 130 or other rotatable fastener such as rivets, nuts and bolts, pins, etc. Some of the structural supports are also coupled to each other by way of a sliding arrangement. The foldable step 100 has a right side R and a left side L that may be mirror images of each other. Alternatively, the two sides may be the same thereby reducing manufacturing costs. The right side R and left sides L are coupled together by at least one step 302 and preferably by two steps 302 and 304 (an upper step 302 and a lower step 304). The two steps 302 and 304 are generally planar pieces of wood, plastic, metal, or composite materials and may have a roughened stepping surface to prevent a person from slipping. Alternatively, the roughened surface may be provided by way of an adhesive tape.

In addition, the right side R and left side L may be coupled together at the back of each side by an upper cross member 306 and a lower cross member 310. The cross members 306, 310 are fastened to a cupboard support member 102 aligned with the cupboard door (not shown). The upper cross member 306 may be coupled to the cupboard door by one or more brackets 308. The brackets 308 may be secured to the cupboard door by gluing or with screws. The lower cross member 310 may be held to the cupboard door using a clip or bracket 312. During installation, the bracket 312 is installed at an appropriate height for the foldable step 100. The lower cross member 310 is then placed into the bracket 312 allowing the installer to more easily mark to position of the top brackets 308 or alternatively the installer may screw or fasten the upper cross member 306 using the top brackets 308 without marking the position.

For the left side L, the cupboard support member 102 is pivotally coupled to two offset members 104 and 106 that enable a vertical support member 108 to contact the floor F situated outside of the cupboard. These offset members 104 and 106 are of sufficient length as to enable the foldable step 100 to be installed into cupboard of varying heights. The lower offset member 106 further comprises a notch 126 that, during folding of the foldable step 100, aligns with one or more pins 130 allowing for complete folding of the foldable step 100 into a profile approximately the width of one of the support members.

In this embodiment, the vertical support member 108 is pivotally coupled to an upper step support member 110 and a lower step support member 112. The step support members 110, 112 are generally horizontal when the foldable step 100 is in an in-use configuration. The vertical support member 108 comprises at least two notches 120 and 124 similar to the notch 126 as previously described. These two notches 120 and 124 align with one or more pins 130 during folding in order to minimize the profile.

The upper step support member 110 is preferably coupled at one end to the vertical support member 108 at a top end being the opposite a floor end in contact with the floor F. The upper step support member 110 is pivotally coupled at the other end to one end of an angled support member 116 and one end of an inter-step support member 114. During use, the angled support member 116 extends downwardly from the upper step support member 108 at an angle of between 20 and 40-degrees from vertical.

The lower step support member 112 is pivotally coupled at one end approximately midway between the floor end and the top end of the vertical support 108, but the coupling point is determined by the desired step height (e.g. a 7-inch rise and 11-inch run). The inter-step support member 114 extends downwardly from the upper step support member 110 in a generally vertical direction and is pivotally coupled to the lower step support member 112 approximately 60% of the length from the end coupled to the vertical support member 108. The angled support member 116 is slidably coupled to the lower step support member 112 by way of a slot 122. The slot 122 comprises approximately 24 percent of the length of the lower step support member 112, but may be other lengths depending on the configuration of the foldable step 100. When completely folded outward in the in-use configuration, each side L and R is supported by the vertical support member 108 and the angled support member 116 contacting the floor F. In addition, the retainer of the angled support member 116 is at an end within the slot 122 furthest from the cupboard.

Figure 2:
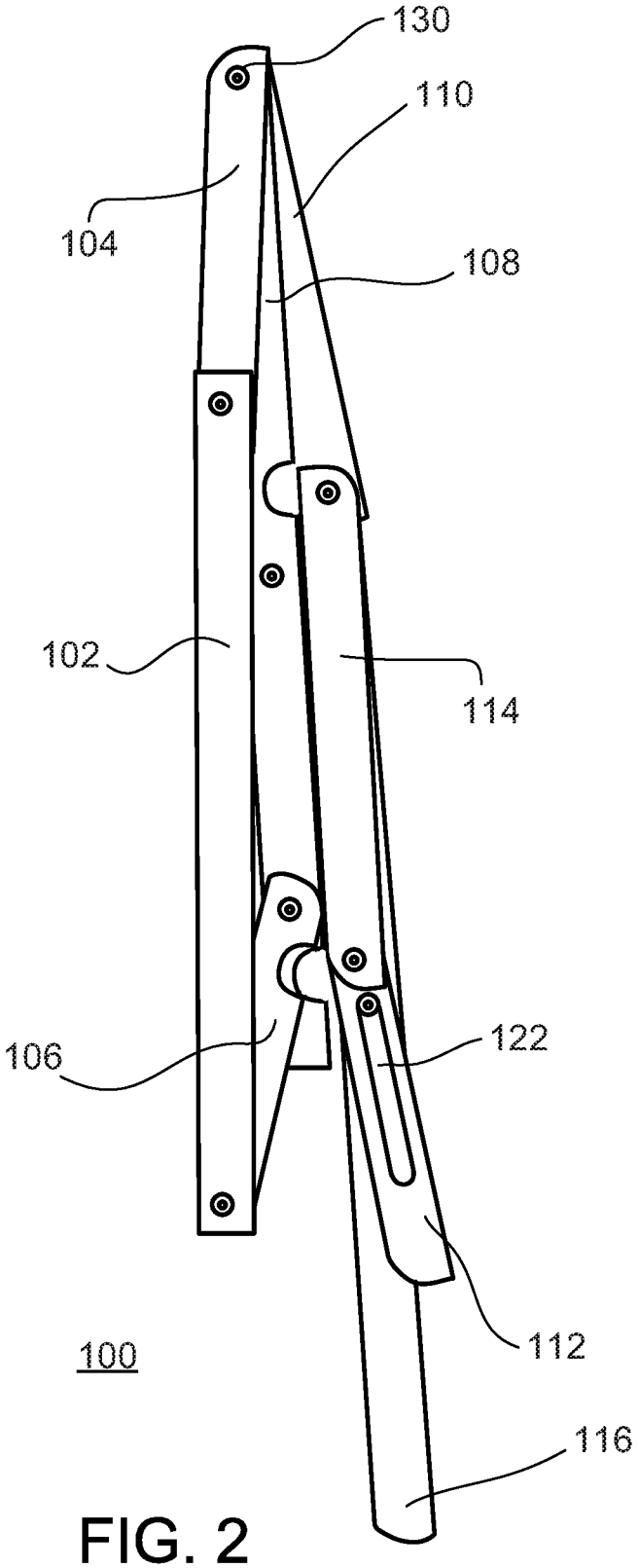
FIG. 2 shows a side view of the foldable step of FIG. 1 in a partially folded configuration.

Turning now to FIG. 2, the foldable step 100 is presented in a partially folded state. As can be more clearly observed, the notches 120, 124, and 126 are generally aligned with corresponding pins 130 at the connection points of the other members. The retainer of the angled support member 116 is now at the opposite end within the slot 122.

Although the description above describes the left side L, the description equally applies to the right hand side R.

Although the structural supports 102, 104, 106, 108, 110, 112, 114, 116 are depicted herein with a particular width, other embodiments may vary the width in order to carry the intended load and provide necessary structural stability for various sizes of people. The structural supports may be solid rectangular shapes but could also be tubular. Other embodiments may have structural supports 102, 104, 106, 114 being narrower than structural supports 110, 112, 116, and 124.

Another embodiment of the present invention is depicted with reference to FIGS. 4-9. A foldable step 200 for installing within a cupboard is shown. The foldable step 100 has a right side R and a left side L. Each of the right side R and the left side L comprises a vertical support member 108, an upper step support member 110, an outer lower step support members 112, an inner lower step support member 113, a diagonal support member 150, and an angled support 116. The foldable step 100 also includes an upper step 302, a lower step 304, and a front horizontal support member 140.

The vertical support member 108 has a top end and a floor end for resting on floor F. The upper step support member 110 has a first end pivotally coupled to the top end of the vertical support member 108, and has a second end. A longitudinal slot 111 extends between the second end of upper step support member 110 to an intermediate point along the upper step support member 110. The intermediate point may be a point that is half way between the first end and the second end, or it may be any point between the first and second ends of the upper step support member 110.

The inner and outer lower step support members 113 and 112, respectively are each longer than the upper step support member 110, and each has a first end pivotally coupled to the vertical support member 108 between the top end and the floor end thereof. A longitudinal slot 122 is formed in the outer lower step support member 112, between the second end thereof and an intermediate point therealong. The intermediate point may be half way between the first end and second end of the outer lower step support member 112 or any point between the first and second ends thereof.

The diagonal support member 150 has a first end pivotally coupled to the vertical support member 108 between the upper step support member 110 and the lower step support members 112 and 113. The diagonal support member 150 has a second end which is slidably coupled to the longitudinal slot 111 formed in the upper lower step support member 110. Accordingly, the upper step support members 110 of both the right side R and left side L serve to support an upper step, and provide a slidable connection to the diagonal support member 150. The diagonal support member 150 hence provides additional strength to the foldable step while allowing it to fold in a minimal profile.

The angled support member 116 has a top end pivotally coupled to the second end of the upper step support member 110, and a floor end. The angled support member 116 is slidably coupled at an intermediate point thereof to the longitudinal slot 122 of the outer lower support member 112.

The upper step 302 is supported by upper step support member 110 on both the right side R and the left side L of the foldable step 200. Similarly, the lower step 304 is supported by the lower step support members 112 and 113 on both the right side R and the left side L of the foldable step 200.

A front horizontal support member 140 extends between the angled support member 116 of the right side R and the angled support member 116 of the left side L. The front horizontal support member 140 is positioned for further supporting the lower step 304 when the foldable step 200 is in an in-use position. Specifically and advantageously, the front horizontal support member 140 provides a rigid connection with the left and right angled support members 116, such that they act as one support. When the foldable step 200 is in the in-use position, loading on the lower step 304 is transferred to the front horizontal support member 140 by resting on it. Advantageously, the lower step can support additional weight while maintaining robustness.

In one embodiment, the inner and outer lower step support members 112 and 113 are each pivotally coupled to the vertical support member 108 approximately midway between the top end and the floor end.

Figure 8:
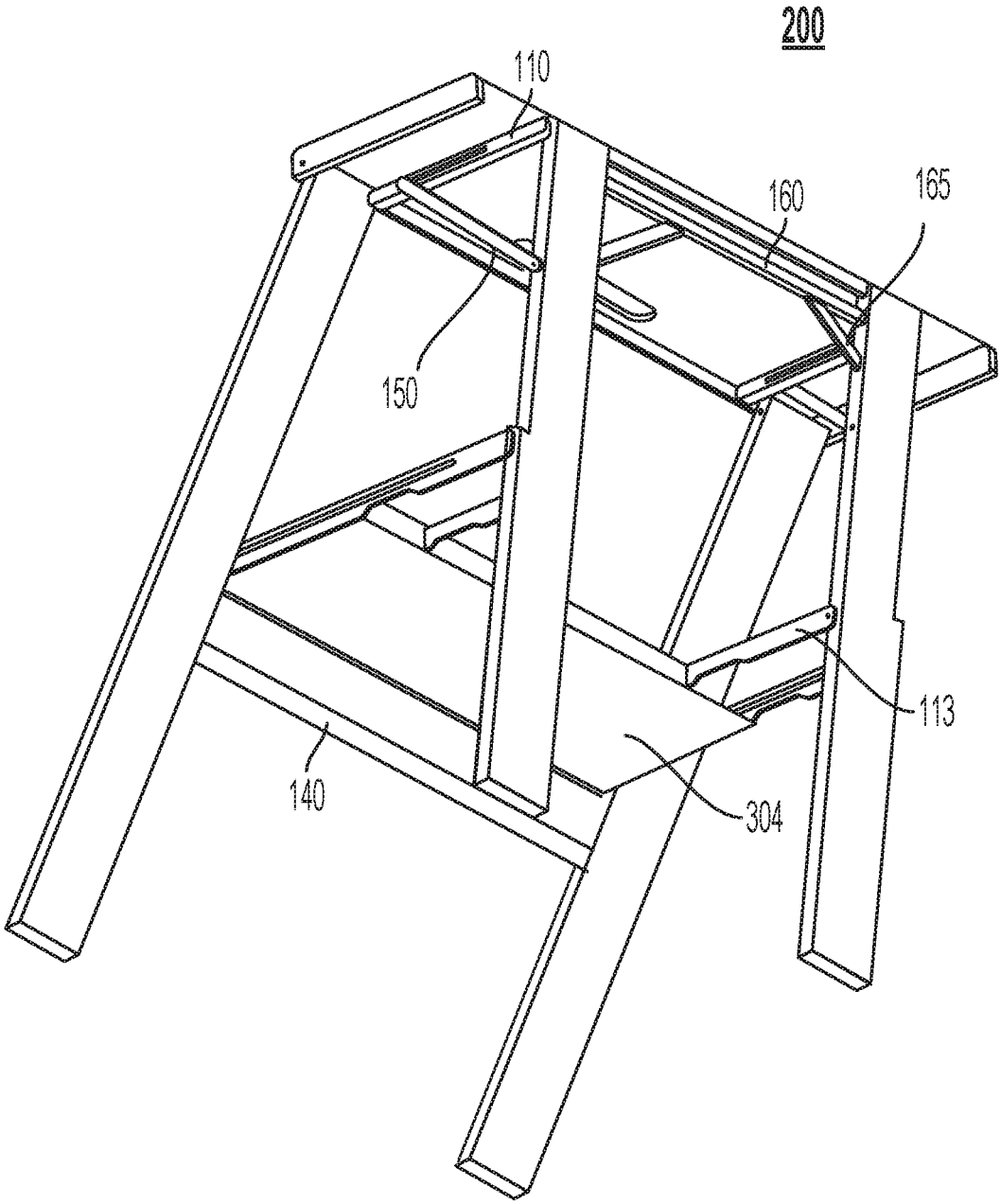
FIG. 8 shows a rear perspective view of a variation of the foldable step of FIG. 4, featuring an additional rear support, in accordance with another embodiment of the present invention.

In one embodiment, shown in FIG. 8, the foldable step 200 further includes a rear horizontal support member 160 for providing additional rigidity between the vertical support members 108 of the right side R and the left side L, and for providing additional support to the upper step 302 when the foldable step is in the in-use position. In one embodiment, a right and a left rear diagonal support members 165 connect the rear horizontal support members 160 to the corresponding vertical support member 108 for providing lateral resistance and stability.

Figure 9:
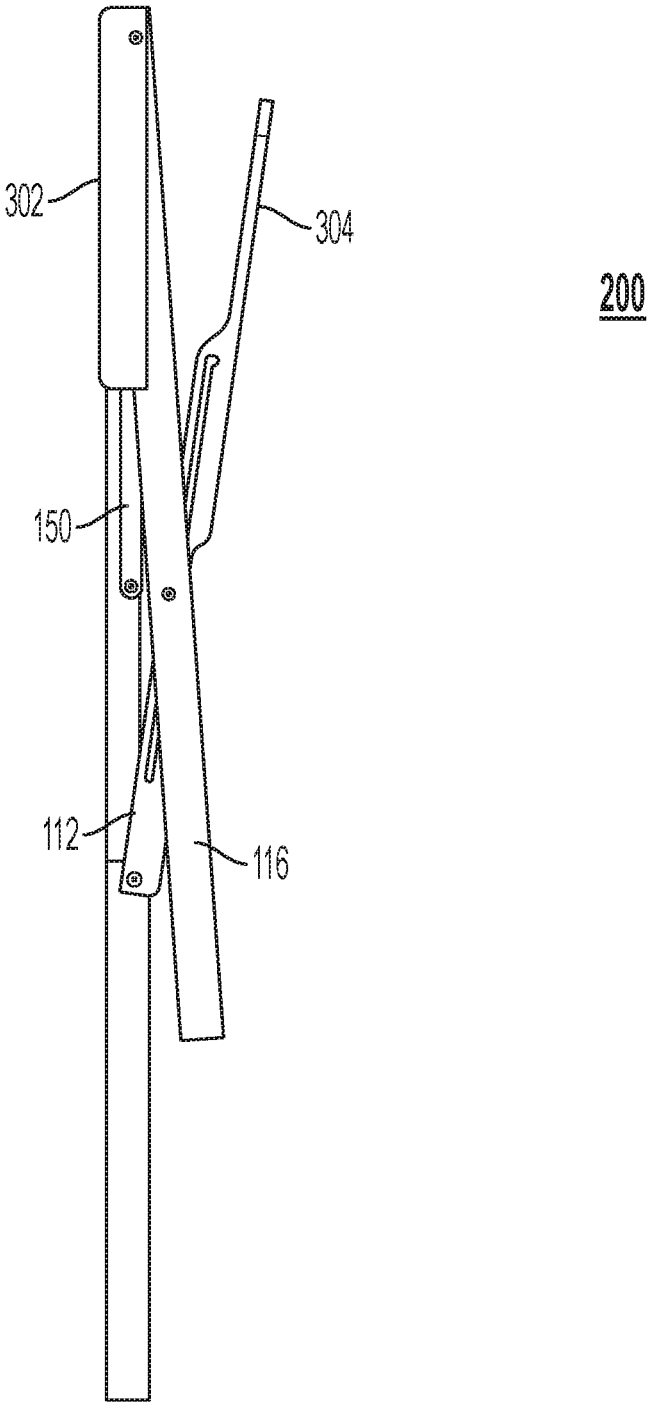
FIG. 9 shows a side view of the foldable step of FIG. 4 in a partially folded configuration.

FIG. 9 shows the foldable step 200 in a folded position. In the folded position, the upper step 302 is folded up using the top of the vertical support member as a pivot point. The diagonal support member slides along the slot 111 of the upper step support member 110. Similarly the lower step 304 is also folded up, and the diagonal support member 116 slides along the slot 122 of the outer lower step support member 112.

In one embodiment, the foldable step 200 further includes a coupling assembly for coupling the foldable step 200 to a cupboard. In one embodiment, the coupling assembly is comprised of an upper cross member 306, a lower cross member 310, which are fastened to a cupboard member 102, as described earlier with reference to FIGS. 1-3. Additionally, the cupboard support member 102 may be pivotally coupled to two offset members 104 and 106 that enable the vertical support member 108 to contact the floor F situated outside of the cupboard as described earlier.

In one embodiment, the lower offset member 106 has a notch, and the notch aligns with one or more pins 130 allowing for complete folding of the foldable step into a profile approximately the width of the support members as shown in FIG. 2

In one embodiment, the vertical support member 108 has a notch that aligns with one or more pins 130 during folding in order to minimize the profile of the foldable step 200.

Although the upper step 302 and the upper step support members 110 are shown as separate parts, they may be integrally formed with the upper step support members being the sides of the upper step 302.

Although particular dimensions of the structural supports are depicted herein, other embodiments may have longer or shorter dimensions without departing from the scope of the invention.

A number of implementations have been described. Nevertheless, it will be understood that various modifications may be made without departing from the scope of the invention as defined by the claims.

The above-described embodiments are intended to be examples of the present invention and alterations and modifications may be effected thereto, by those of skill in the art, without departing from the scope of the invention, which is defined solely by the claims appended hereto.

What is claimed is:

1. A foldable step for installing within a cupboard comprising:

(i) a right side and a left side each comprising:
- a vertical support member having a top end and a floor end;
- an upper step support member having:
  - a first end pivotally coupled to the top end of the vertical support member,
  - a second end, and
  - a longitudinal slot extending between the second end thereof and an intermediate point theralong;
- an inner and an outer lower step support member, each:
  - being longer than the upper step support member,
  - having a first end pivotally coupled to the vertical support member between the top end and the floor end thereof, and
  - having a second end,
- a longitudinal slot formed in the outer lower step support member between the second end and an intermediate point theralong;
- a diagonal support member having:
  - a first end pivotally coupled to the vertical support member between the upper step support member and the outer and inner lower step support members, and
  - a second end slidably coupled to the longitudinal slot formed in the upper step support member;
- an angled support member:
  - having a top end pivotally coupled to the second end of the upper step support member and a floor end, and
  - being slidably coupled at an intermediate point thereof to the longitudinal slot of the outer lower step support member;

(ii) an upper step supported by the upper step support members of the right and left sides;

(iii) a lower step supported by the inner and outer lower step support members of the right and left sides; and (iv) a front horizontal support member extending between the angled support members of the right and left sides, and positioned for supporting the lower step when the foldable step is in an in-use position.

2. The foldable step according to claim 1, further comprising a coupling assembly for coupling the foldable step to the cupboard.

3. The foldable step according to claim 1, further comprising a rear horizontal support member extending between the right and left vertical support members, and positioned for further supporting the upper step when the foldable step is in the in-use position.

4. The foldable step according to claim 3, further comprising a right and a left rear diagonal support members connecting the rear horizontal support member to the vertical support members of the right and left sides, respectively, for providing lateral resistance and stability.

5. The foldable step according to claim 1 wherein the lower step support member is pivotally coupled to the vertical support member approximately midway between the floor end and the top end.

6. The foldable step according to claim 2, wherein the coupling assembly comprises:
- an upper cross member and a lower cross member coupled in a horizontal orientation to the cupboard;
- a left and a right cupboard support members aligned vertically with the cupboard and each coupled to the upper and lower cross members; and
- a right and a left two offset members each pivotally coupled at one end to the cupboard support member; and pivotally coupled at the other end to the right and left vertical support members, respectively.

7. The foldable step according to claim 6, further comprising at least one notch in the lower offset member.

8. The foldable step according to claim 7, wherein the at least one notch aligns with one or more pins allowing for complete folding of the foldable step into a profile approximately the width of one of the support members.

9. The foldable step according to claim 8, further comprising at least one notch in the vertical support member.

10. The foldable step according to claim 7, wherein the at least one notch aligns with one or more pins during folding in order to minimize a profile of the foldable step.

11. The foldable step according to claim 6, further comprising at least one bracket for coupling the upper cross member and lower cross member to the cupboard.

12. The foldable step according to claim 6, wherein the left and right cupboard support members are each vertically aligned with a door of the cupboard.

13. The foldable step according to claim 11, wherein the at least one bracket is secured to the cupboard using an adhesive or a fastener.

14. The foldable step according to claim 1, wherein the angled support member has an angle of between 20 and 40 degrees from vertical.

15. The foldable step according to claim 1, wherein the upper step and the upper step support members are integrally formed.

* * * * *